US011352785B2

(12) United States Patent
Simmons, Jr. et al.

(10) Patent No.: US 11,352,785 B2
(45) Date of Patent: Jun. 7, 2022

(54) CONSTRUCTION BLOCK UNITS

(71) Applicant: B & B Flying Service, Inc., Buttonwillow, CA (US)

(72) Inventors: Felix J. Simmons, Jr., Toluca Lake, CA (US); Brad Bittleston, Buttonwillow, CA (US)

(73) Assignee: B & B Flying Service, Inc., Buttonwillow, CA (US)

( * ) Notice: Subject to any disclaimer, the term of this patent is extended or adjusted under 35 U.S.C. 154(b) by 0 days.

(21) Appl. No.: 17/512,336

(22) Filed: Oct. 27, 2021

(65) Prior Publication Data

US 2022/0049494 A1 Feb. 17, 2022

Related U.S. Application Data

(63) Continuation-in-part of application No. 17/037,295, filed on Sep. 29, 2020, now Pat. No. 11,186,987.

(60) Provisional application No. 62/968,911, filed on Jan. 31, 2020.

(51) Int. Cl.

| | |
|---|---|
| ***E04B 2/18*** | (2006.01) |
| ***E04B 2/26*** | (2006.01) |
| ***E04C 1/00*** | (2006.01) |
| *E04B 2/02* | (2006.01) |

(52) U.S. Cl.

CPC ..... *E04B 2/18* (2013.01); *E04B 2/26* (2013.01); *E04C 1/00* (2013.01); *E04B 2002/0239* (2013.01); *E04B 2002/0263* (2013.01)

(58) Field of Classification Search

CPC ..... E04B 1/12; E04B 2002/0208; E04B 2002/021; E04B 2002/0226; E04B 2002/0228; E04B 2002/0234; E04B 2002/0236; E04B 2002/0239; E04B 2002/0252; E04B 2002/0289;

(Continued)

(56) References Cited

U.S. PATENT DOCUMENTS

| | | | |
|---|---|---|---|
| 3,180,059 | A | 4/1965 | Persak, Jr. |
| 3,440,788 | A | 4/1969 | Merget |

(Continued)

FOREIGN PATENT DOCUMENTS

| | | | |
|---|---|---|---|
| BE | 1025223 | B1 | 12/2018 |
| FR | 3014461 | A1 | 6/2015 |

(Continued)

*Primary Examiner* — Ryan D Kwiecinski

(74) *Attorney, Agent, or Firm* — SoCal IP Law Group LLP; Mark Andrew Goldstein; Nikki Dossman

(57) ABSTRACT

A construction block unit includes a construction block including a bottom plate having a rectangular shape, sidewalls attached to each side of the bottom plate via hinges, wherein the sidewalls rotate on the hinges from a position planar with the bottom plate for storage to a position perpendicular to the bottom plate to form a receptacle configured to receive and contain a weight, and a pair of interlocking portions, each at opposite sides of the construction block to fasten the sidewalls in the position perpendicular to the bottom plate. Each of the pair of interlocking portions is shaped to receive a corresponding interlocking portion of a second construction block by vertically sliding the corresponding interlocking portion into the interlocking portion.

20 Claims, 11 Drawing Sheets

(58) Field of Classification Search
CPC ..... E04B 2002/0291; E04B 2/14; E04B 2/18; E04B 2/26; E04C 1/00; E04C 1/40
USPC ..... 52/596, 605
See application file for complete search history.

(56) References Cited

U.S. PATENT DOCUMENTS

| | | | | | |
|---|---|---|---|---|---|
| 3,702,520 | A * | 11/1972 | Huber | E04B 2/04 | 52/284 |
| 4,608,799 | A * | 9/1986 | Hasegawa | A63H 33/10 | 446/112 |
| 4,688,365 | A | 5/1987 | McGuire | | |
| 4,685,892 | A * | 8/1987 | Gould | A63H 33/062 | 446/109 |
| 5,281,185 | A * | 1/1994 | Lee | A63H 33/10 | 446/109 |
| 6,257,411 | B1 * | 7/2001 | Bacques | B65D 5/001 | 206/508 |
| 6,394,705 | B1 | 5/2002 | Lefebvre | | |
| 7,704,011 | B2 | 4/2010 | Marshall | | |
| 7,765,744 | B2 * | 8/2010 | Herron | E04H 9/04 | 52/79.5 |
| 7,988,516 | B2 * | 8/2011 | Bishop | A63H 33/082 | 446/85 |
| D686,756 | S | 7/2013 | Nanayakkara | | |
| 8,910,438 | B1 | 12/2014 | Shiban | | |
| 9,145,249 | B2 * | 9/2015 | Adams | E04C 1/39 | |
| 9,364,767 | B2 * | 6/2016 | Fox | A63H 33/086 | |
| 10,106,980 | B2 | 10/2018 | Martinez | | |
| 10,744,419 | B2 * | 8/2020 | Xia | E04H 1/1205 | |
| 11,110,368 | B2 * | 9/2021 | Nawracala | A63H 33/044 | |
| 11,173,413 | B2 * | 11/2021 | Ishimatsu | A63H 33/086 | |
| 2003/0098256 | A1 * | 5/2003 | Lu | B65D 21/0217 | 206/511 |
| 2006/0000179 | A1 | 1/2006 | Albert | | |
| 2007/0130873 | A1 * | 6/2007 | Fisher | E04C 3/07 | 52/596 |
| 2012/0175377 | A1 * | 7/2012 | Masci | B65D 88/528 | 220/615 |
| 2014/0106108 | A1 | 4/2014 | Lin et al. | | |
| 2018/0222081 | A1 * | 8/2018 | Mohamed | E04B 2/22 | |
| 2018/0347188 | A1 | 12/2018 | Parks et al. | | |
| 2019/0211548 | A1 * | 7/2019 | Thurston | E04B 2/18 | |
| 2019/0390452 | A1 * | 12/2019 | Baker | E04B 2/18 | |
| 2021/0238846 | A1 | 8/2021 | Zhang et al. | | |
| 2021/0238847 | A1 | 8/2021 | Simmons, Jr. | | |
| 2021/0363754 | A1 * | 11/2021 | Thorp | E04C 1/40 | |

FOREIGN PATENT DOCUMENTS

| | | | | | |
|---|---|---|---|---|---|
| GB | 2004578 | A | 4/1979 | | |
| GB | 2443630 | A | 5/2008 | | |
| GB | 2521759 | A * | 7/2015 | E04C 1/40 | |
| GB | 2587712 | A * | 4/2021 | E04B 2/18 | |
| WO | 2006129115 | A1 | 12/2006 | | |
| WO | 2012143585 | A1 | 10/2012 | | |
| WO | WO-2014125490 | A2 * | 8/2014 | A63H 33/086 | |
| WO | WO-2015084274 | A1 * | 6/2015 | E04B 2/18 | |

* cited by examiner

CONSTRUCTION BLOCK UNITS

RELATED APPLICATION INFORMATION

This patent is a continuation-in-part of application Ser. No. 17/037,295, entitled CONSTRUCTION BLOCK UNITS, filed Sep. 29, 2020, which claims priority from provisional patent application No. 62/968,911, entitled CONSTRUCTION BLOCKS, filed on Jan. 31, 2020, the entire contents of each of which are incorporated herein by reference.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

Field

This disclosure relates to construction blocks, and, more particularly, to interlocking construction blocks.

Description of the Related Art

Habitable structures, such as those used for houses, businesses, and storage, need to be constructed of sturdy and durable materials that can withstand various weather conditions over time to usefully protect the people and things inside the structure. Further, the materials should also be sturdy enough to deter or prevent unwanted intruders, whether animal or human. These materials are also ideally resistant to mold, fungus, water damage, insect damage, and other types of decay. The materials must also not make the environment inside the structure toxic to the inhabitants, for example, by emitting poisonous vapors or particles into the air inside the structure Some traditional construction materials for building structures, such as concrete, cinder blocks, metal, and bricks, can be expensive, heavy to transport, and unwieldy to manipulate during the construction process. Further, these traditional construction materials typically require additional bonding material, such as mortar, to bond the construction materials in a useful way. The bonding material can also be expensive, heavy, and require laborious mixing with water.

Other types of construction materials, such as wood, stucco, and vinyl, require time-consuming installation by a team of skilled workers with special tools, which can be expensive and slow the construction process. These materials can also be costly.

There is a great need for safe and affordable structures due to quickly rising housing costs and increasing numbers of homeless people. Improved construction materials that fulfill the sturdiness requirements of habitable structures, yet are inexpensive and easy to transport and manipulate, are desirable to help provide this suitable and affordable housing.

Throughout this description, elements appearing in figures are assigned three-digit or four-digit reference designators, where the two least significant digits are specific to the element and the one or two most significant digit is the figure number where the element is first introduced. An element that is not described in conjunction with a figure may be presumed to have the same characteristics and function as a previously described element having the same reference designator.

DETAILED DESCRIPTION

Description of Apparatus

Construction block units disclosed herein are an improved material for constructing structures. Each construction block has structural elements to provide a light-weight, rigid, and stable building material. These construction blocks can be inexpensively manufactured and are lightweight to transport and manipulate. Further, the construction blocks can be coupled together without the need for additional materials such as mortar or cement. The construction blocks can include various sizes and shapes, and can be assembled together in various configurations to construct desired structures. The hollow interiors of the construction blocks can be filled with a weight, such as sand or water, to create sturdy and durable structure walls for various uses, such as for homes and businesses.

Figure 1:
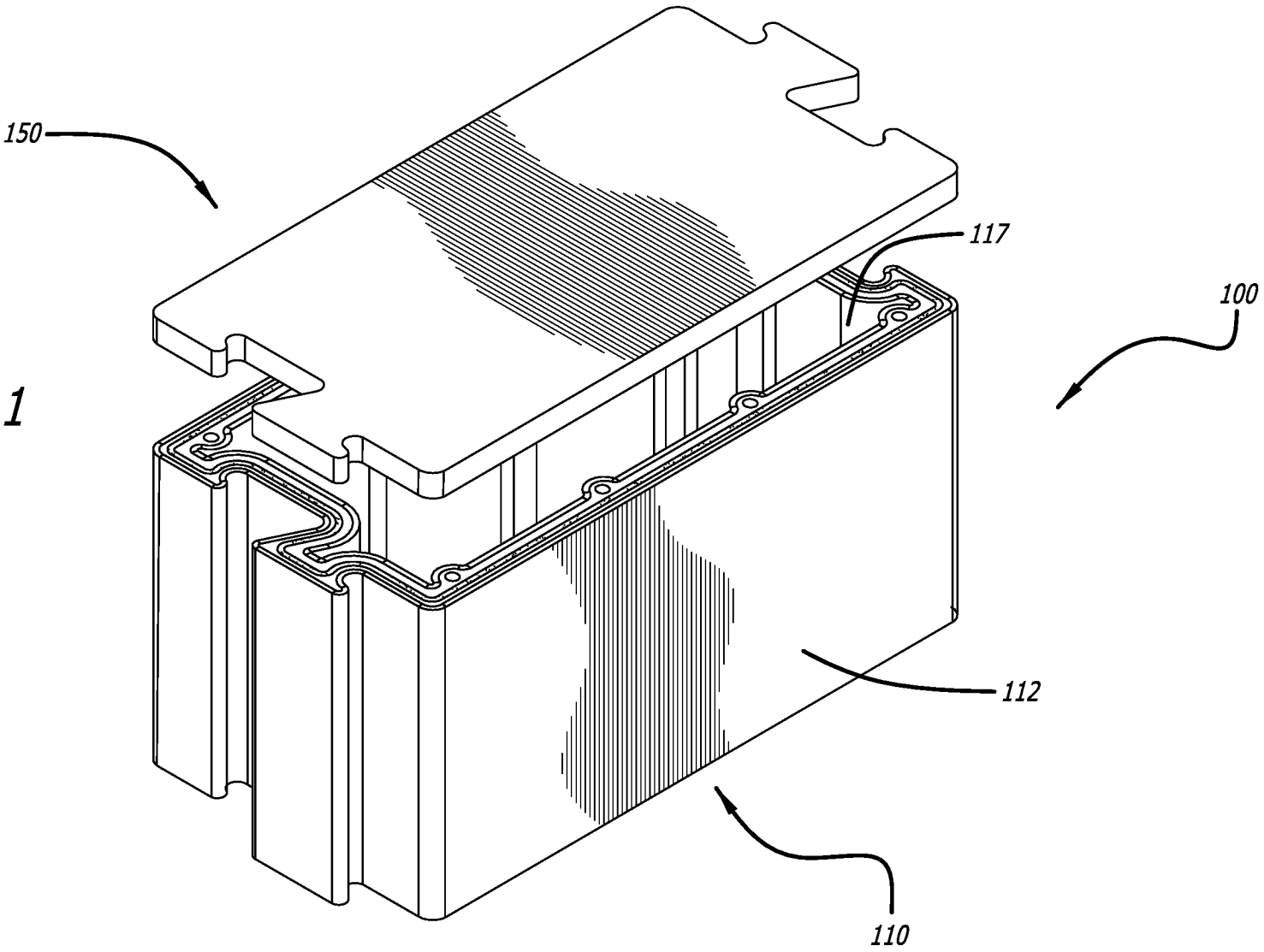
FIG. 1 shows a perspective view of a construction block unit including a construction block and a lid.
Figure 2:
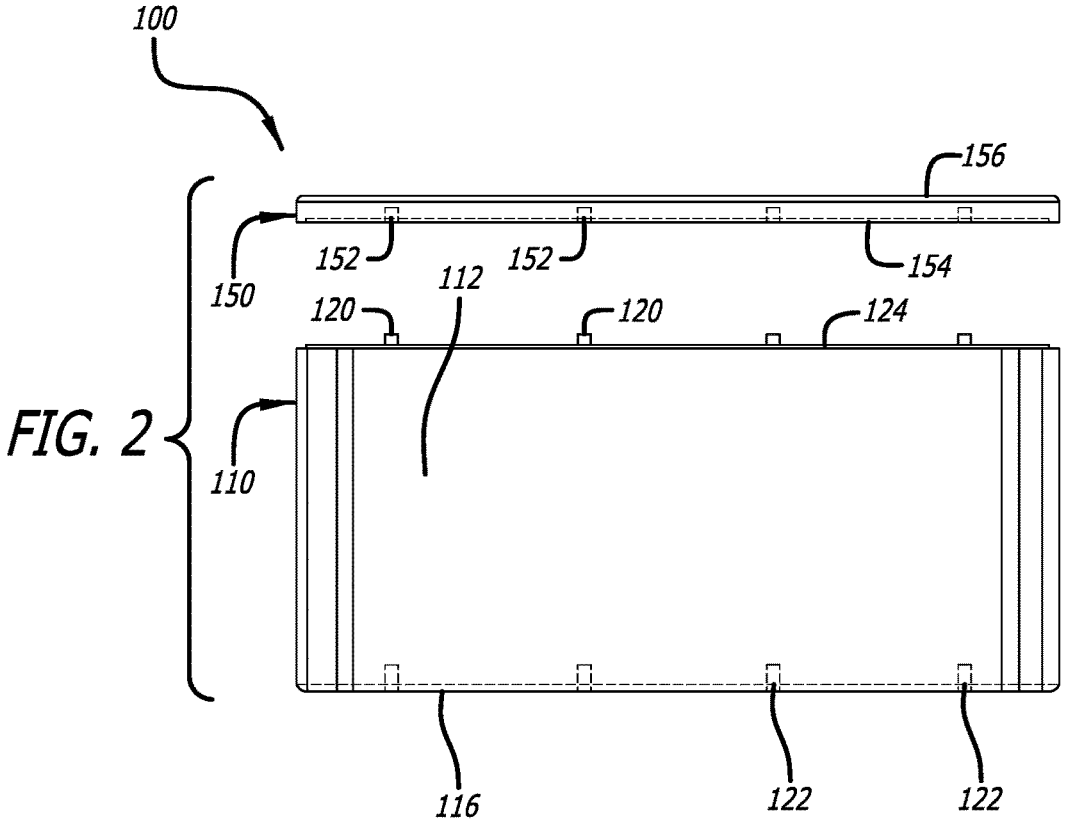
FIG. 2 shows a side view of the construction block and the lid of FIG. 1.
Figure 3:
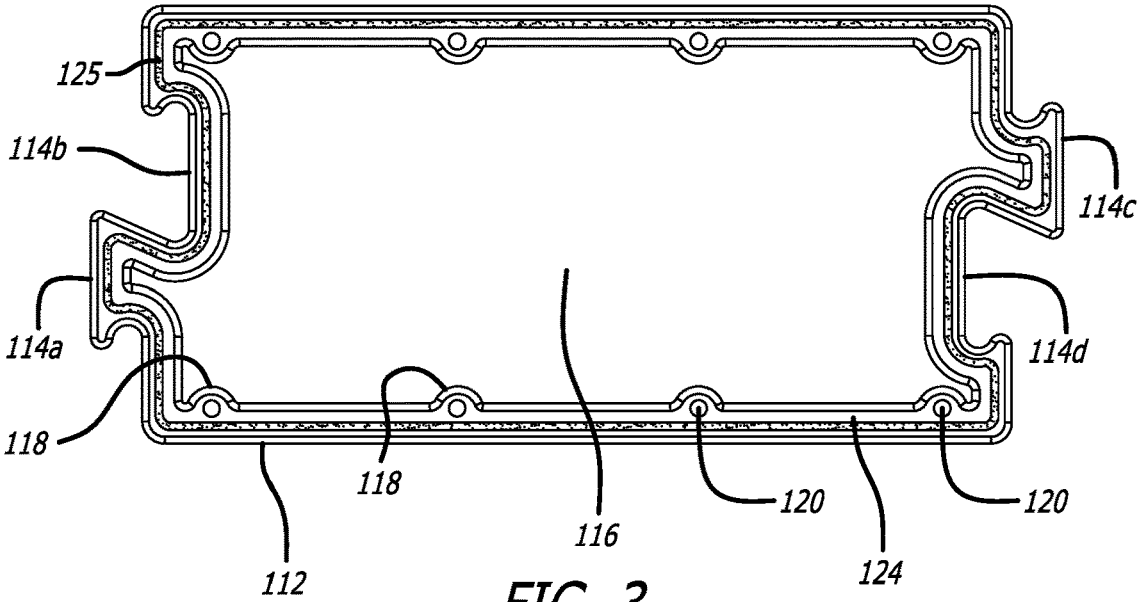
FIG. 3 is a top view of the construction block of FIG. 1.

FIG. 1, FIG. 2, and FIG. 3 show a construction block unit 100 having a substantially rectangular prism shape with an interlocking portion 114*a*, 114*b* at one end and another interlocking portion 114*c*, 114*d* at an opposite end. The construction block unit 100 includes a construction block 110 and a lid 150.

The construction block 110 can have any suitable size and dimensions for use in construction of structures. For example, the width of the construction block 110 can be in a range from 4 inches to 24 inches. A typical width of the construction block 110 can be in a range from 6 inches to 12 inches, such as 8 inches. Exemplary lengths of the construction block 110 can be in a range from 4 inches to 36 inches. A typical width of the construction block 110 can be in a range from 10 inches to 24 inches, such as 16 inches.

The construction block 110 has a substantially vertical sidewall 112 extending from an outer edge of a substantially planar bottom plate 116. The vertical sidewall 112 can be any suitable height for use in construction. For example, the vertical sidewall 112 can have a height in a range from 3 inches to 48 inches. Typical vertical sidewall 112 heights can be in a range from 6 inches to 24 inches, such as 8 inches. A thickness of the vertical sidewall 112 can be based on the material from which the sidewall is constructed. The thickness can be a suitable thickness to support the weight of materials used for weighting the construction block 110, such as sand or water, and support weight of additional materials positioned on top, such as additional construction blocks and roofing material. For example, the thickness can be in a range from 0.4 inches to 1.5 inches. A typical thickness can be in a range from 0.5 inches to 0.9 inches, such as 0.6 inches.

The bottom plate 116 has a shape corresponding to a bottom edge of the sidewall 112. The sidewall 112 connects to the bottom plate 116 to enclose an open space container 117 in the interior of the construction block 110, which is suitable for receiving and containing a weight. The sidewall 112 and the bottom plate 116 can be formed at the same time as one continuous piece. Alternatively, the sidewall 112 and the bottom plate 116 can be formed separately and then joined by any suitable means, such as an adhesive or melting contacting pieces together. A thickness of the bottom plate 116 can be any suitable thickness, and can be the same or different from the sidewall 112 thickness.

An interlocking portion including a tab 114*a* and a blank 114*b* are on one side of the construction block 110. The tab 114*a* and the blank 114*b* can be formed by bends and curves in the sidewall 112, and can extend vertically along some or all of the side. The tab 114*a* and the blank 114*b* are configured to interlock with a corresponding blank and tab of another construction block. For example, when viewed from above, one or more sections of a top of the sidewall appear to bend to form tabs, while one or more other sections can bend to form blanks, much like a puzzle piece. In the example shown in FIG. 2, the tab 114*a* broadens as the tab 114*a* extends towards the exterior, and the blank 114*b* broadens as the blank 114*b* extends towards the interior.

To interlock the construction blocks 110 to construct a wall, a first construction block can be held above and aligned with a second construction block such that when the first construction block is lowered into place, the tab of the first construction block slides into the blank of the second construction block and the tab of the second construction block slides into the blank of the first construction block to interlock the sidewalls of the first construction block and the second construction block. For example, the corresponding blank and tab of another construction block can slide vertically into the tab and blank such that the construction blocks are interlocked. Horizontal forces are prevented from pulling the construction blocks apart when the construction blocks are interlocked. The construction blocks can be separated again by sliding one vertically with respect to the other.

The construction block 110 can have another interlocking portion including a tab 114*c* and a blank 114*d* on an opposite side of the construction block 110. Thus, the construction block 110 can be interlocked with other construction blocks on both sides. Many construction blocks can be interlocked to create a horizontal layer of a structure.

The sidewall 112 can be shaped to have either sharp corners or rounded corners, or may have some corners that are sharp while others are rounded.

The construction block 110 can include strengthening structural ribs 118 disposed on the walls at suitable intervals. In one example shown in FIG. 2 and FIG. 3, the structural ribs 118 can extend vertically along an interior surface of the sidewall 112. The structural ribs 118 can have any suitable thickness for providing an increase in structural strength of the sidewall 112 and the construction block 110 to increase the weight that can be supported. For example, the structural rib 118 can have a thickness of in a range from 0.2 inches to 1 inch, such 0.245 inches.

The construction block 110 can further include fasteners 120 for coupling the construction block to either a lid 150 or another construction block. The fasteners 120 can be located at ends of the structural ribs 118 that extend beyond a top edge 124 of the sidewall 112, or any other suitable location, e.g., along a top edge 124 of the sidewall 112. For example, the fasteners 120 can be cylindrical, like pegs, or can have several sides, such as three, four, or six sides. The fasteners 120 can have any suitable dimensions for coupling the construction block. For example, the fastener 120 can have a height in a range from 0.2 inches to 1 inch, such as 0.320 inches, and can have a thickness in a range from 0.2 inches to 0.5 inches, such as 0.245 inches.

The fasteners 120 can be received by a corresponding element of another construction block, such as an opening 122 on a bottom surface of the bottom plate 116. For example, the fasteners 120 can be received by the opening 122 with a friction fit. Thus, the dimensions of the opening 122 are dimensions that are suitable for receiving the fastener 120 with a friction fit. The construction block 110 may further be fastened to another construction block with adhesive, which can also be applied to the fasteners 120 and/or openings 152. In this way, the construction block 110 can be fastened to the top of another construction block. The top construction serves as a cover for the container 117 of the construction block positioned below to contain any weight in the container 117 and prevent any other materials from being placed in the lower construction block.

The number of fasteners 120 and corresponding openings 122 can be any suitable number for fastening one construction block to another. For example, the number of fasteners 120 and corresponding openings 122 can be in a range from 3 to 20. In FIGS. 1, 2, and 3, eight fasteners 120 are shown.

The lid 150 has a congruent shape to the bottom plate 116 and is configured to close the open space container 117 in the interior of the construction block 110. The lid 150 can have any suitable thickness to close the container 117, which may be the same or different from the thicknesses of the sidewalls 112 and the bottom plate 116. For example, the lid 150 can have a thickness of 0.6 inches.

The lid 150 has openings 152 positioned to correspond to and receive the fasteners 120 such that the lid 150 is fastenable to the construction block 110, for example, with a friction fit. The dimensions of the openings 152 are dimensions that are suitable for receiving the fastener 120 with a friction fit. In this way, the lid 150 can be fastened to the construction block 110. The lid 150 may further be fastened to the construction block 110 with adhesive, which can also be applied to the fasteners 120 and/or openings 152. For example, the lids can be fastened to construction blocks at the top of a wall being constructed. The lids can contain any weight in the container 117 and prevent any other materials from being placed in the lower construction block.

The construction block 110 and the lid 150 can be constructed of the same or different materials. For example, the construction block 110 and the lid 150 can be formed of plastics, polymers, composite materials, fiberglass, metal, foam, and recycled materials.

The container 117 can be filled with any suitable material to add weight to the construction block and stability to the structure, including, but not limited to, water, sand, concrete, dirt, rocks, and gravel.

A seal 125 can be positioned at the top edge 124 of the sidewall 122. The seal 125 seals the construction block 110 to either another construction block positioned above it or a lid 150 to further contain any weight in the container 117 and prevent any other materials from being placed in the container 117. The seal 125 can be any suitable material, such as foam, rubber, polymers, plastic, silicone, and wax. The seal 125 may also have an adhesive to adhere the seal 125 to construction block and/or the seal. The seal 125 can have any suitable thickness for sealing a lid or a construction block to another construction block. For example, the seal can have a thickness in a range from 0.05 inches to 0.3 inches, such as 0.1 inches.

The construction blocks can include other features that allow the construction blocks to be used with other building materials. For example, the construction blocks can have surfaces that are appropriately textured for painting or application of siding, stucco, adhesive, insulation, drywall, or plaster. The construction blocks may also be able to receive coupling devices, such as tacks, nails, or screws, so that other types of construction materials can be fastened to the construction blocks.

The construction blocks can be various shapes and sizes such that various different structures can be assembled from the blocks. The different construction blocks can include different shapes so that walls can be constructed at various angles. Construction blocks can also have shapes that allow for door and window openings. The construction blocks can be used to construct exterior and interior walls.

Figure 4:
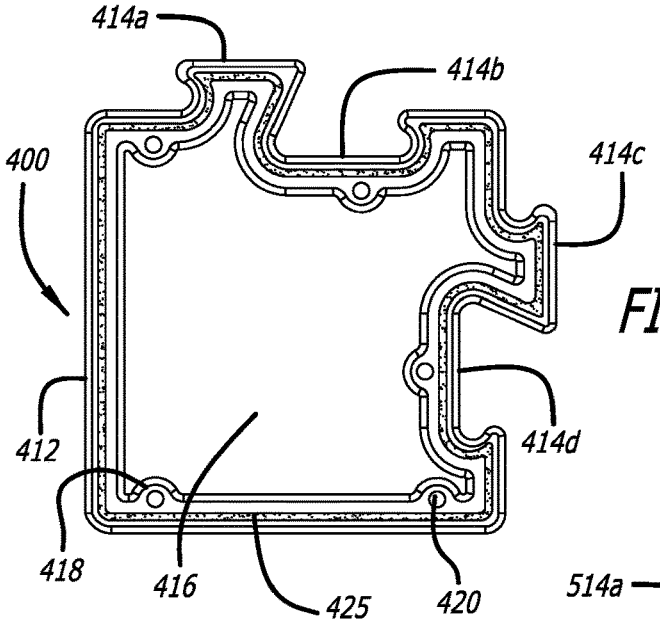
FIG. 4 is a top view of a corner construction block.

FIG. 4 is a top view of a corner construction block 400, which includes a sidewall 412, a bottom plate 416, structural ribs 418, fasteners 420, and a seal 425, as similarly described above. The corner construction block 400 has a first interlocking portion with a tab 414*a* and a blank 414*b*, and a second interlocking portion with a tab 414*c* and a blank 414*d*. The corner construction block 400 can be used at corners of structure walls to connect one wall with another wall at a right angle. A receptacle of corner construction block 400 can also be closed with a lid with a congruent shape.

Figure 5:
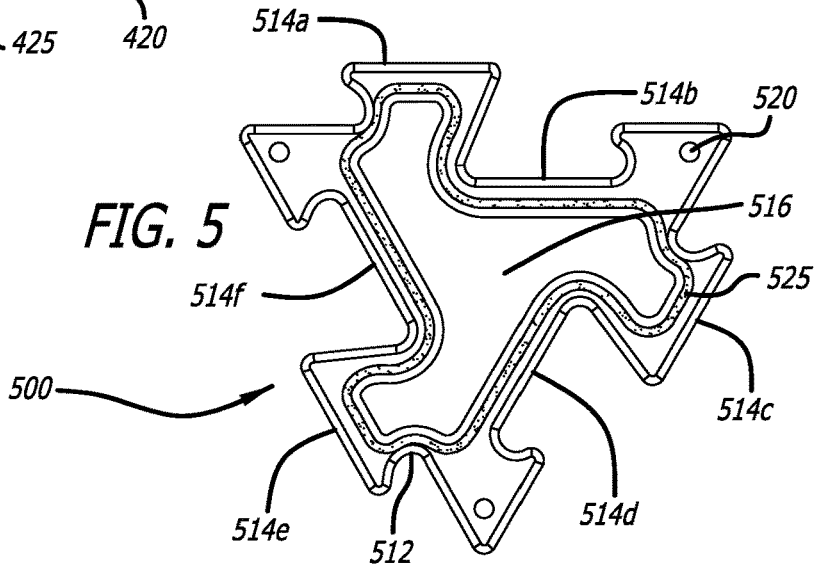
FIG. 5 is a top view of a three-sided construction block.

FIG. 5 is a top view of a three-sided construction block 500, which includes a sidewall 512, a bottom plate 516, fasteners 520, and a seal 525, as similarly described above. The three-sided construction block has a first interlocking portion with a tab 514*a* and a blank 514*b*, a second interlocking portion with a tab 514*c* and a blank 514*d*, and a third interlocking portion with a tab 514*e* and a blank 514*f*. The three-sided construction block 500 can be used to join structure walls at angles of 120 degrees and 240 degrees. A receptacle of three-sided construction block 500 can also be closed with a lid with a congruent shape.

Figure 6:
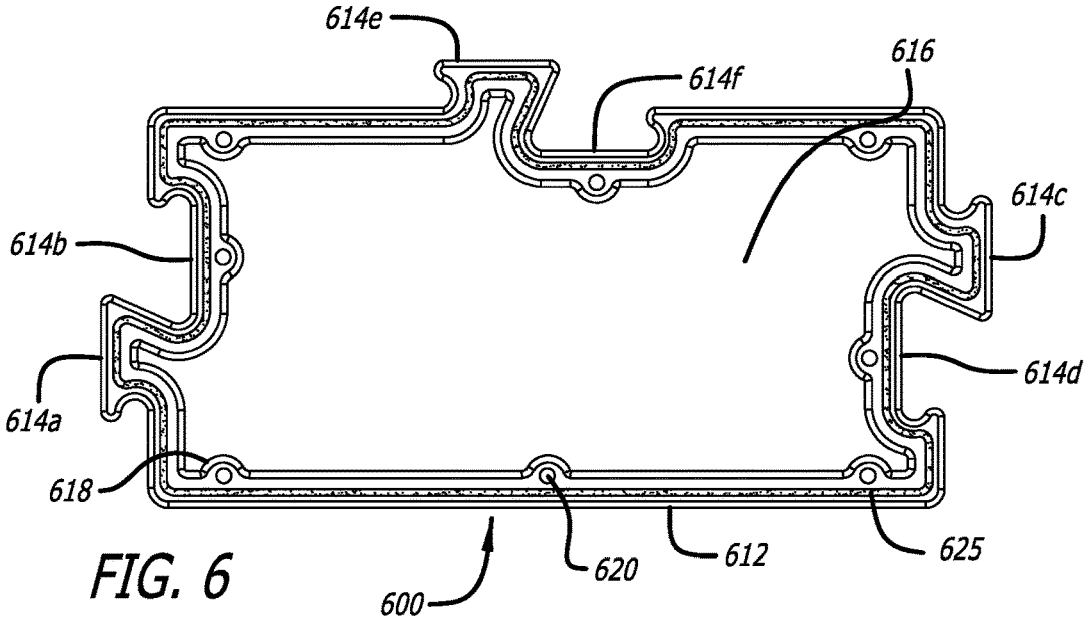
FIG. 6 is a top view of a "T" construction block.

FIG. 6 is a top view of a "T" construction block 600, which includes a sidewall 612, a bottom plate 616, structural ribs 618, fasteners 620, and a seal 625, as similarly described above. The "T" construction block has a first interlocking portion with a tab 614*a* and a blank 614*b*, a second interlocking portion with a tab 614*c* and a blank 614*d*, and a third interlocking portion with a tab 614*e* and a blank 614*f*. The "T" construction block 600 is similar to construction block 100 of FIG. 1, but has the additional third interlocking portion on a wall adjacent to the first interlocking portion. The "T" construction block 600 can be used to construct a "T" shaped structure where one wall intersects with another wall. A receptacle of "T" construction block 600 can also be closed with a lid with a congruent shape.

Figure 7:
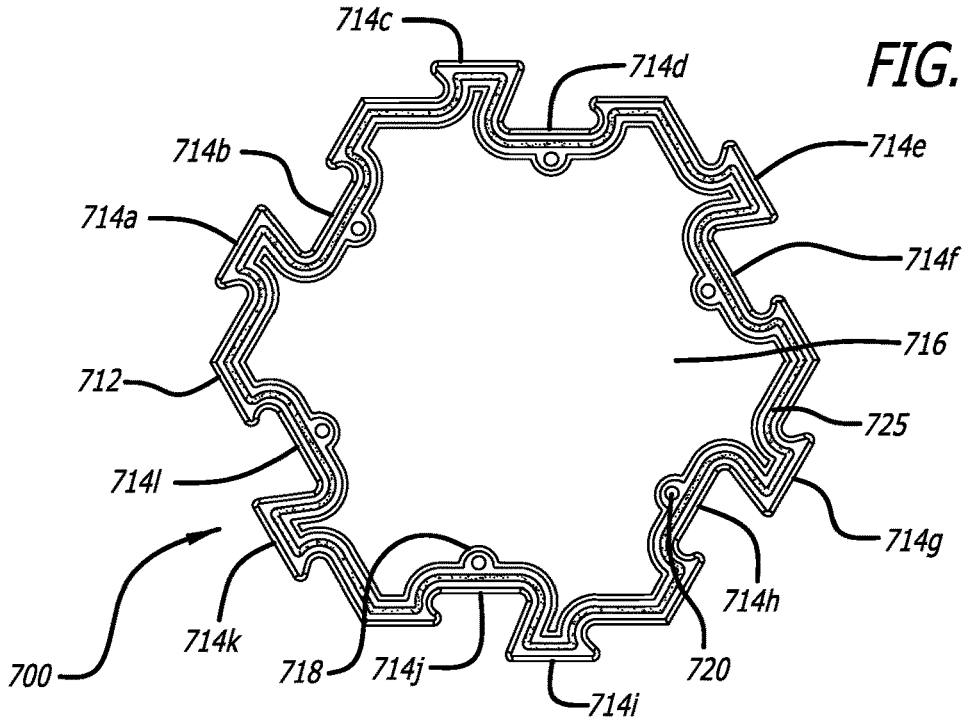
FIG. 7 is a top view of a six-sided construction block.

FIG. 7 is a top view of a six-sided construction block 700, which includes a sidewall 712, a bottom plate 716, structural ribs 718, fasteners 720, and a seal 725, as similarly described above. The six-sided construction block 700 has a first interlocking portion with a tab 714*a* and a blank 714*b*, a second interlocking portion with a tab 714*c* and a blank 714*d*, a third interlocking portion with a tab 714*e* and a blank 714*f*, a fourth interlocking portion with a tab 714*g* and a blank 714*h*, a fifth interlocking portion with a tab 714*i* and a blank 714*j*, and a sixth interlocking portion with a tab 714*k* and a blank 714*l*. The six-sided construction block 700 can be used to join structure walls at angles of 60 degrees, 120 degrees, 180 degrees, 240, degrees, and 300 degrees. A receptacle of six-sided construction block 700 can also be closed with a lid with a congruent shape.

Figure 8:
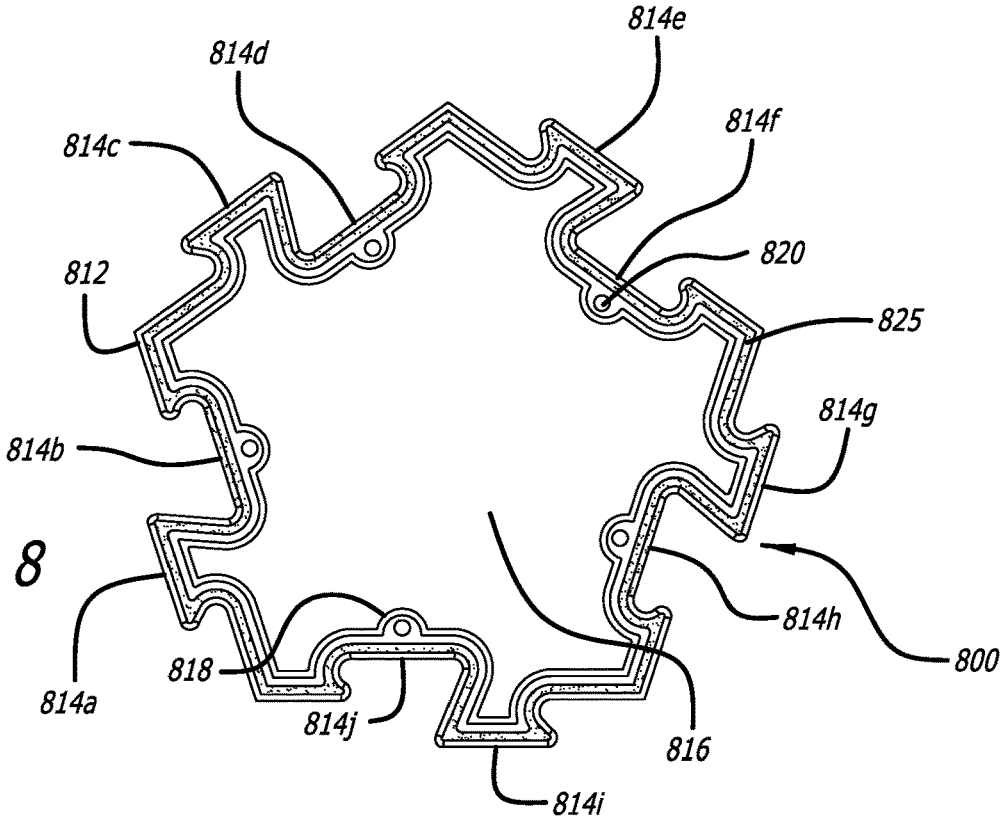
FIG. 8 is a top view of a five-sided construction block.

FIG. 8 is a top view of a five-sided construction block 800, which includes a sidewall 812, a bottom plate 816, structural ribs 818, fasteners 820, and a seal 825, as similarly described above. The five-sided construction block 800 has a first interlocking portion with a tab 818*a* and a blank 814*b*, a second interlocking portion with a tab 814*c* and a blank 814*d*, a third interlocking portion with a tab 814*e* and a blank 814*f*, a fourth interlocking portion with a tab 814*g* and a blank 814*h*, and a fifth interlocking portion with a tab 814*i* and a blank 814*j*. The five-sided construction block 800 can be used to join structure walls at angles of 72 degrees, 144 degrees, 216 degrees, and 288 degrees. A receptacle of five-sided construction block 800 can also be closed with a lid with a congruent shape.

Figure 13:
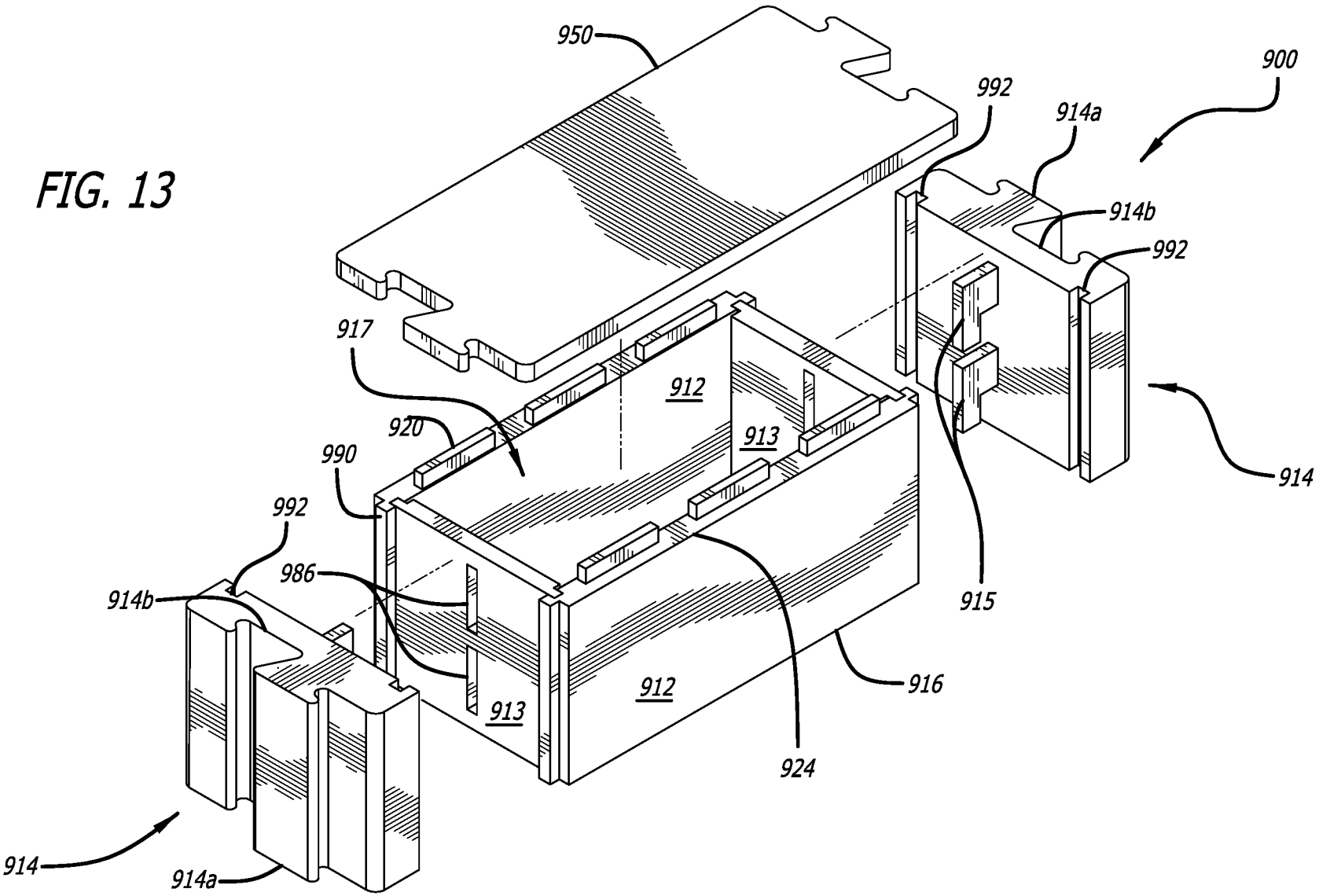
FIG. 13 is an exploded perspective view of a configurable construction block unit including a lid and the configurable construction block of FIG. 9 configured for construction.
Figure 14:
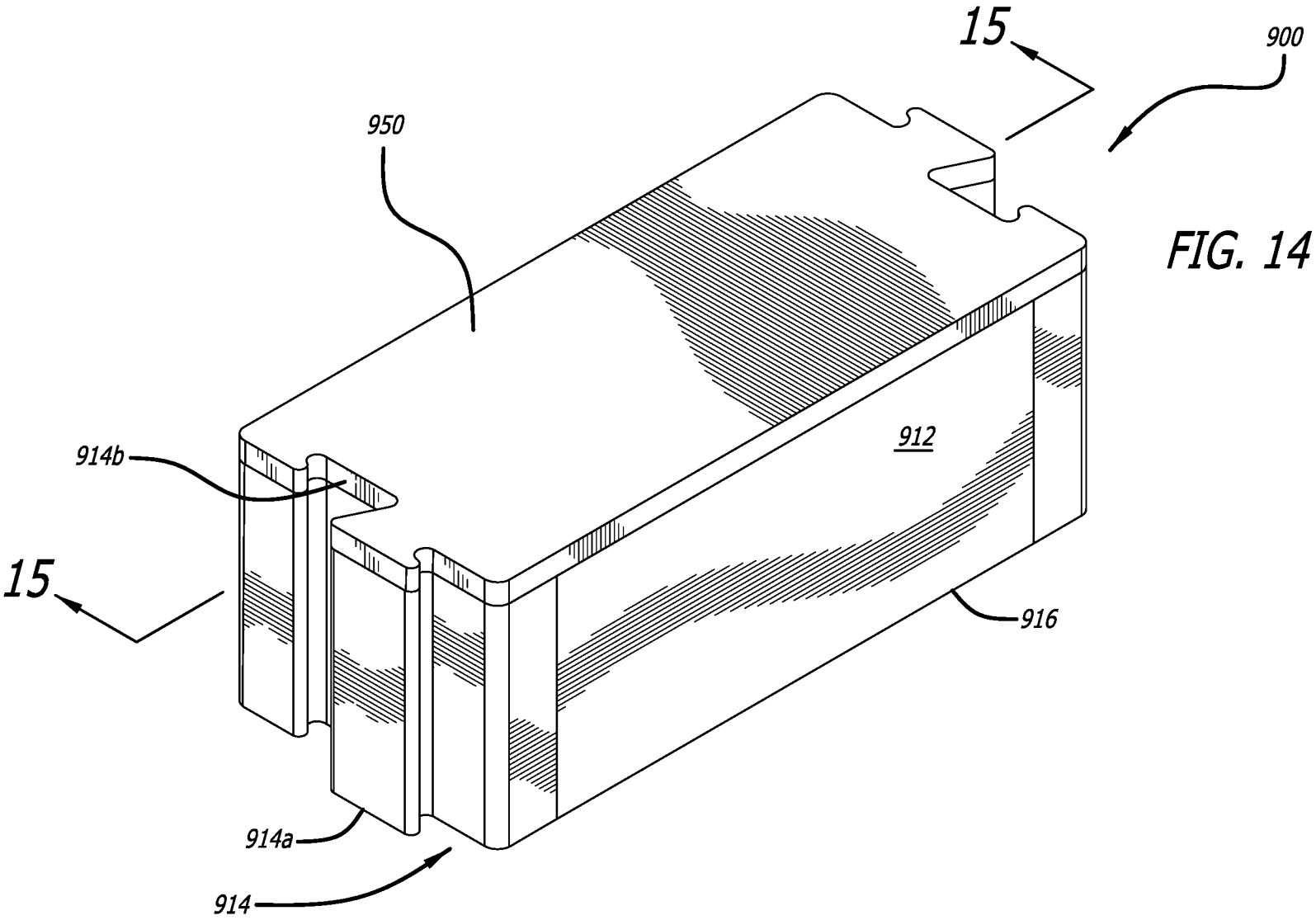
FIG. 14 is a perspective view of the configurable construction block unit of FIG. 13 assembled.
Figure 15:
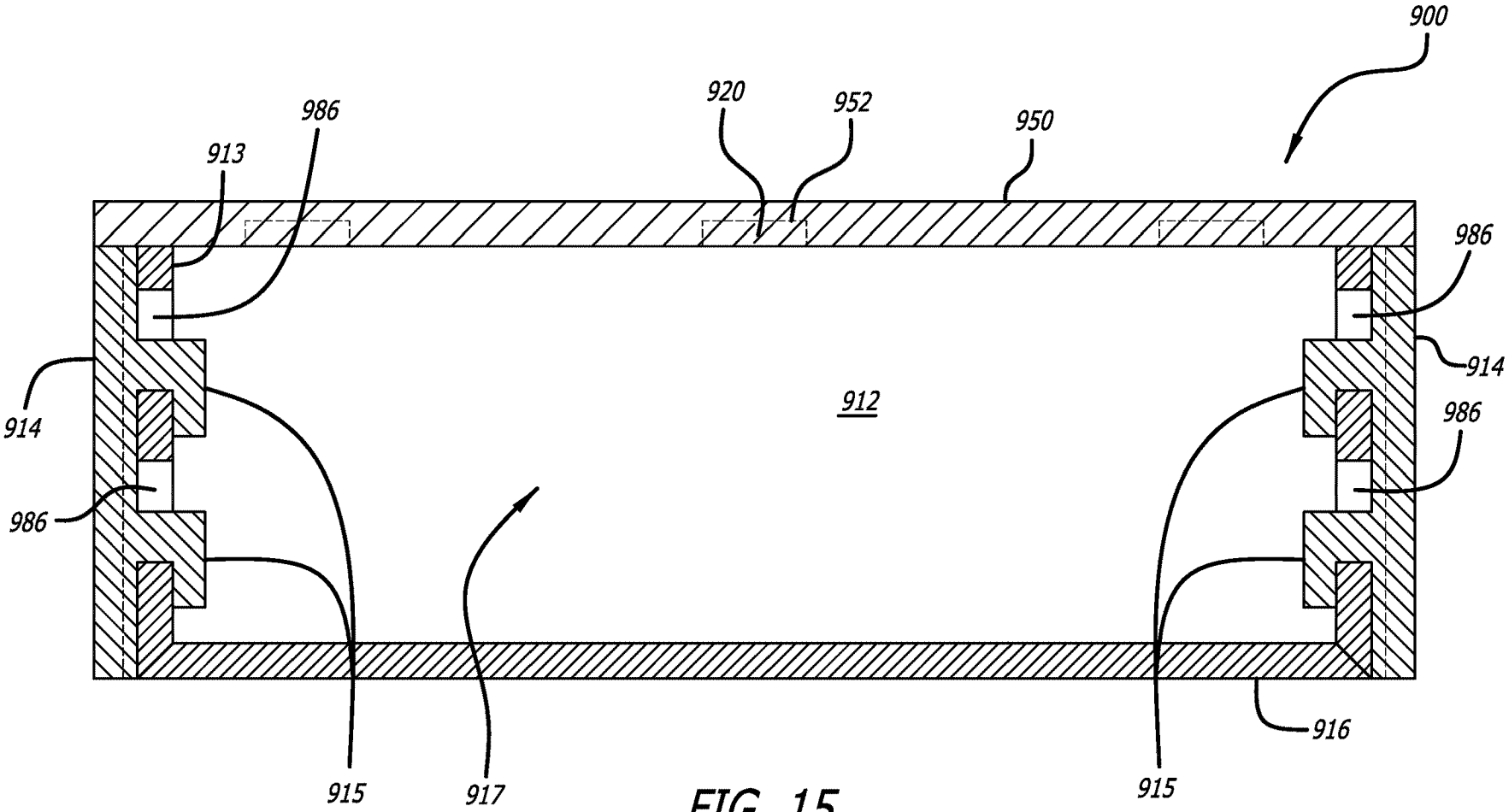
FIG. 15 is a cross-sectional view of the configurable construction block unit of FIG. 13.

FIGS. 9-12 are views of a configurable construction block 910, and FIGS. 13-15 are view of a configurable construction block unit 900, including the configurable construction block 910 and a lid 950. The configurable construction block 910 and the configurable construction block unit 900 can have any of the features described above with respect to FIGS. 1-8. The configurable construction block 910 and the configurable construction block unit 900 have the additional feature of being able to be configured into a flat configuration for easy transport and space-efficient storage.

Figure 9:
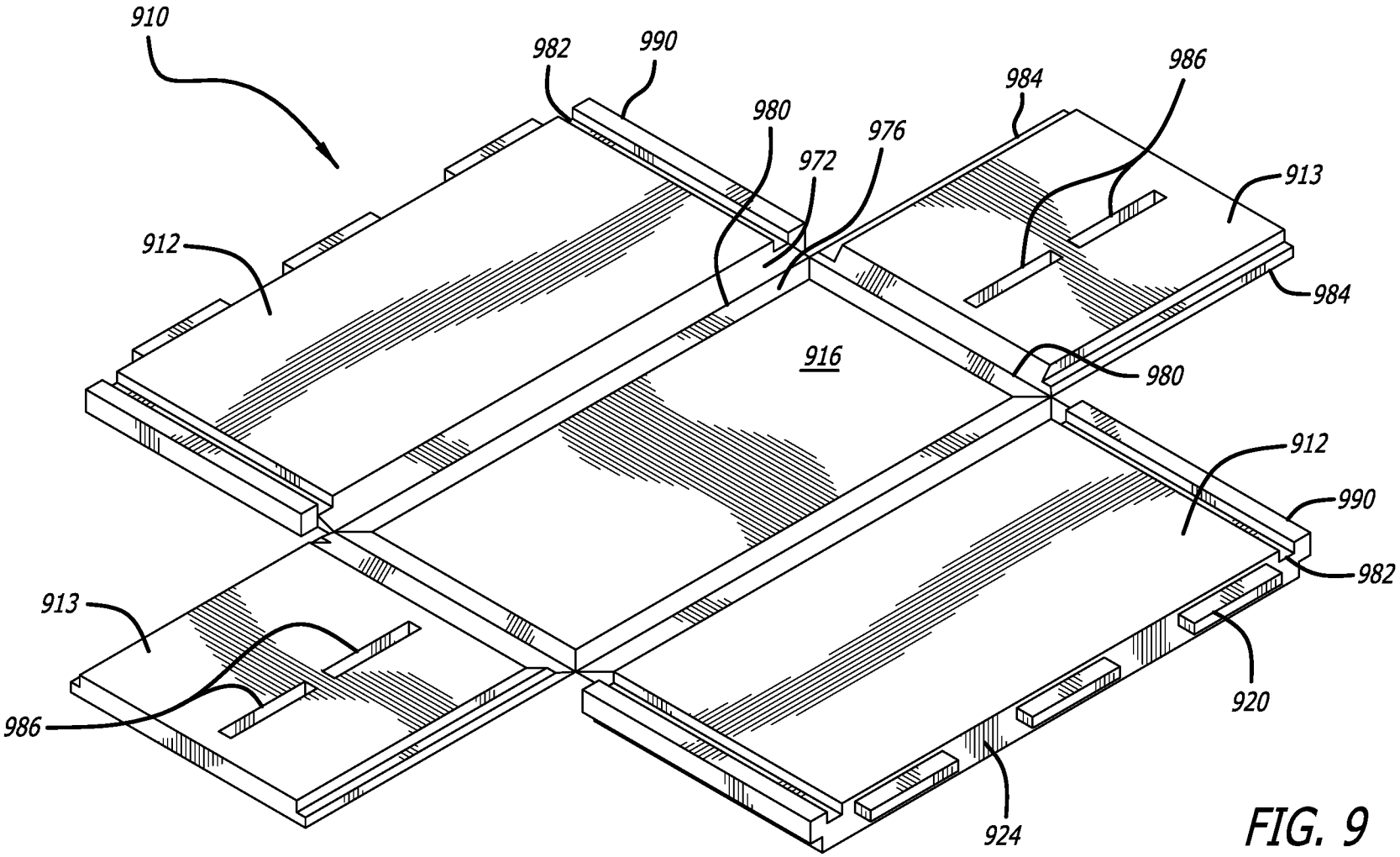
FIG. 9 is a perspective view of a configurable construction block configured for storage.
Figure 10:
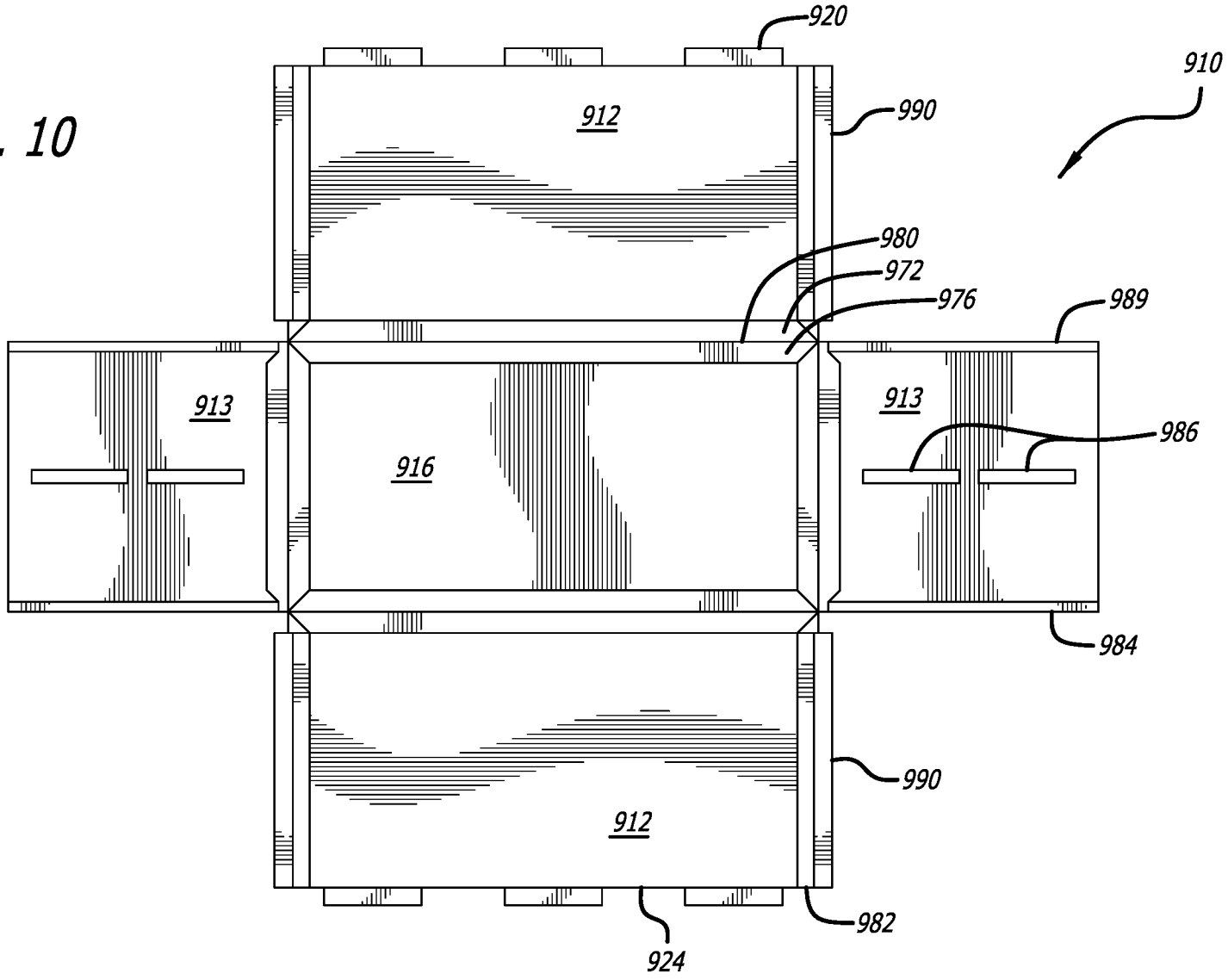
FIG. 10 is a top view of the configurable construction block of FIG. 9.
Figure 11:
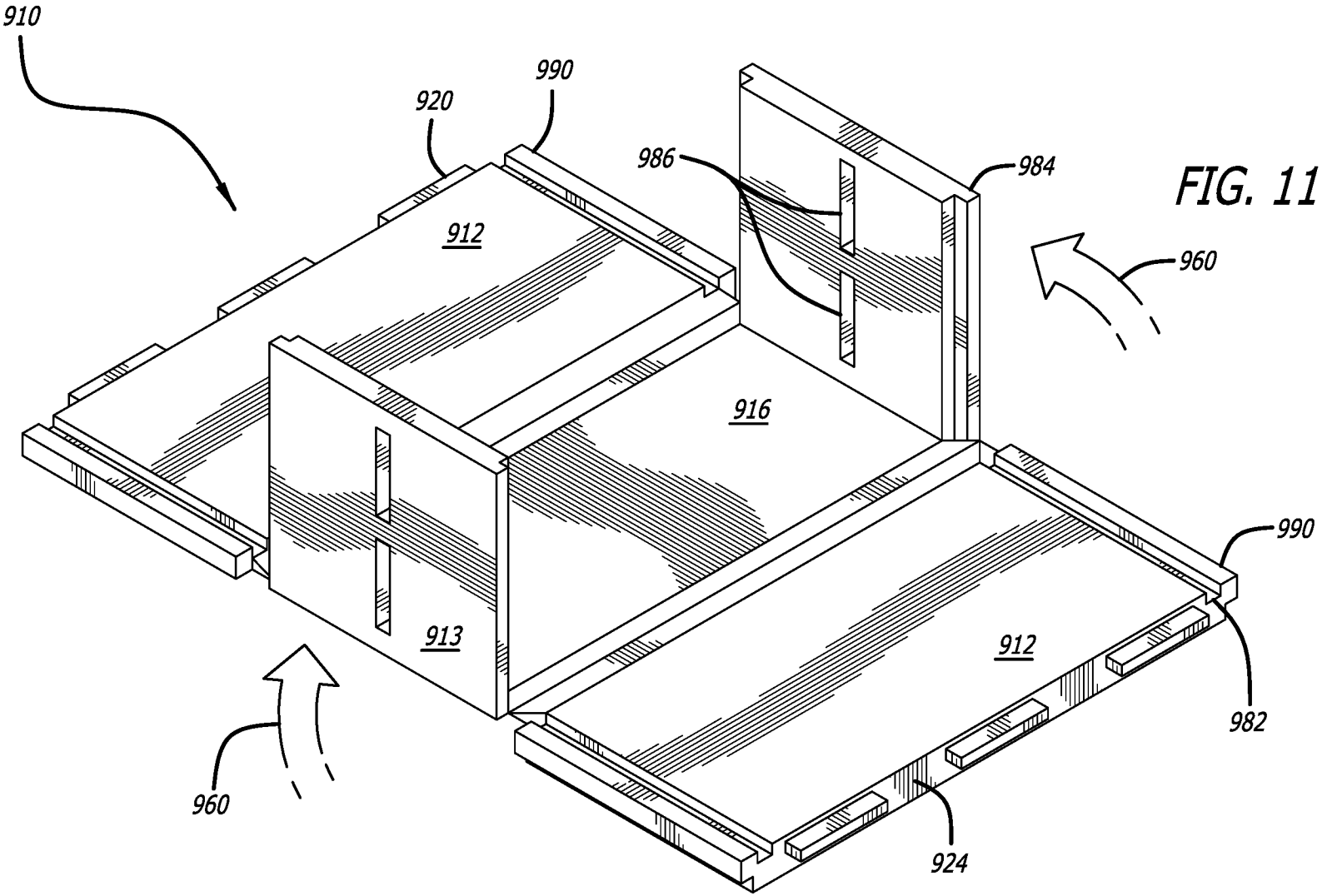
FIG. 11 is a perspective view of the configurable construction block of FIG. 9 showing a step in configuration for construction.
Figure 12:
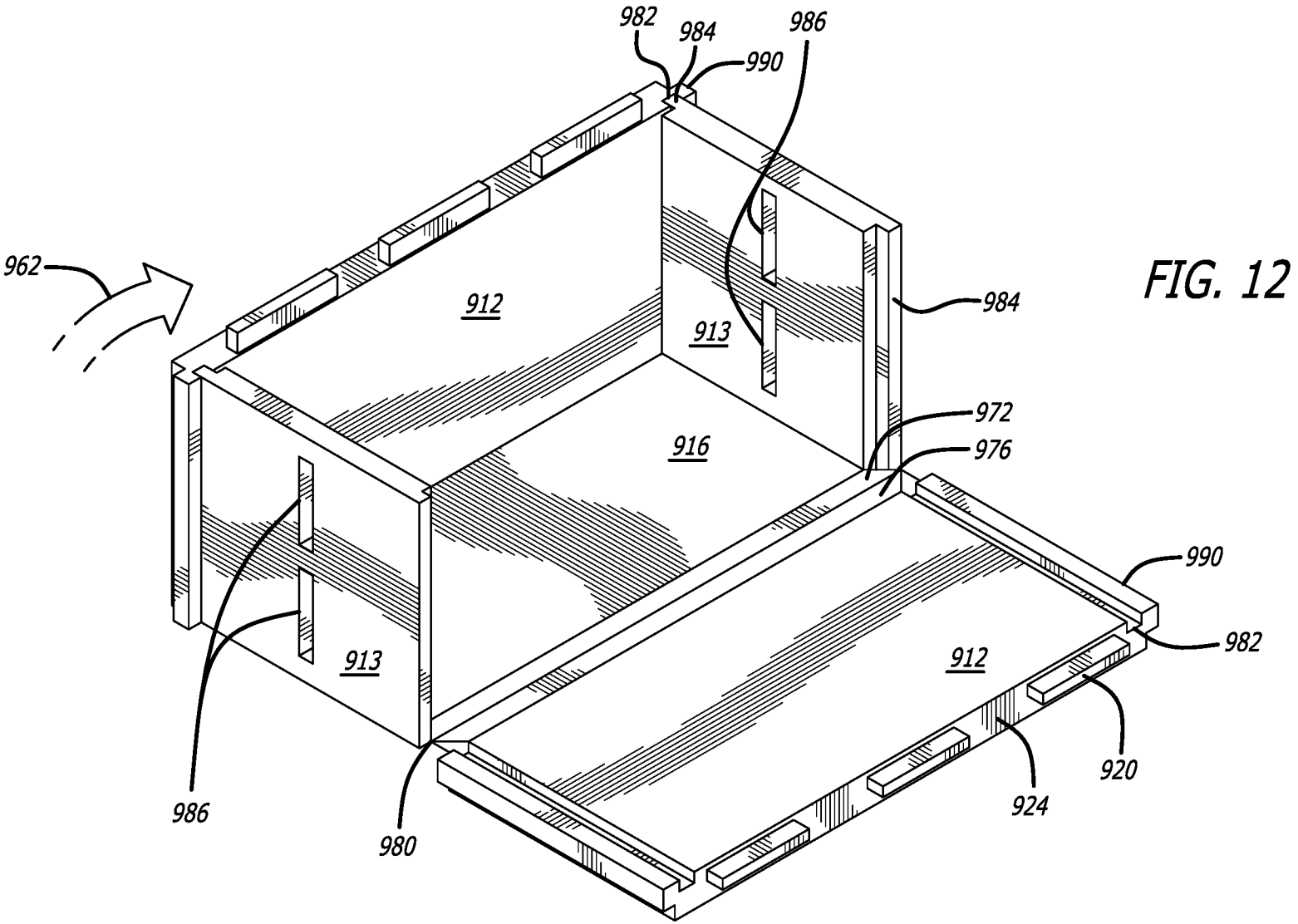
FIG. 12 is a perspective view of the configurable construction block of FIG. 9 showing another step in configuration for construction.

FIGS. 9 and 10 show the configurable construction block 910 in a flat configuration for storage. The construction block 910 can have any suitable size and dimensions for use in construction of structures, such as the sizes and dimensions described with respect to FIGS. 1-8. Opposing first sidewalls 913 and opposing second sidewalls 912 are rotated on respective hinges, e.g., living or integral hinges formed of a thinned portion of the material forming the construction block 910 or any other suitable hinges, to be planar and level with bottom plate 916. First sidewalls 913 and second sidewalls 912 can have a beveled portion 972, or other suitable shape, that corresponds to a beveled portion 976, or other suitable shape, of the bottom plate 916 when the first sidewalls 913 and second sidewalls 912 are rotated to be perpendicular to the bottom plate 916. Further, a seal, such as a foam or rubber strip (not shown) can be on beveled portion 972 and/or beveled portion 976, to seal the first sidewalls 913 and second sidewalls 912 to the bottom plate 916.

The first sidewalls 913 and second sidewalls 912 can be any suitable height for use in construction, as described above with respect to FIGS. 1-8. The thickness can be a suitable thickness to support the weight of materials used for weighting the construction block 910, such as sand or water, and support weight of additional materials positioned on top such as additional construction blocks and roofing material, as described above with respect to FIGS. 1-8.

The opposing first sidewalls 913 can be rotated on their hinges 980 (as shown by arrows 960 in FIG. 11) to extend perpendicularly (or vertically) from the bottom plate 916. Second opposing sidewalls 912 can then be rotated on their hinges 980 (as shown by arrow 962 in FIG. 12) to extend perpendicularly (or vertically) from the bottom plate 916. Opposed edge 984 of the first sidewalls 913 engage opposed grooves 982 of the second sidewalls 912 when both first sidewalls 913 and second sidewalls 912 are rotated to the vertical position. The edges 984 can be a narrowed portion of each first sidewall 913. Further, a seal, such as a foam or rubber strip (not shown) can be on edges 984 and/or grooves 982, to seal the sidewalls 912, 913 to each other. The engagement of the edges 984 with the grooves 982 positions the first sidewalls 913 and second sidewalls 912 in a perpendicular orientation with respect to each other and the bottom plate 916. The first sidewalls 913 and second sidewalls 912 connected to the bottom plate 116 via the respective hinges 980 enclose an open space container 917 in the interior of the construction block 910, which is suitable for receiving and containing a weight, as described above with respect to FIGS. 1-8. The first sidewalls 913, second sidewalls 912, and the bottom plate 916 can be formed at the same time as one continuous piece. Alternatively, the first sidewalls 913, second sidewalls 912, and the bottom plate 916 can be formed separately and then joined by any suitable means, such as an adhesive or melting contacting pieces together. A thickness of the bottom plate 916 can be any suitable thickness, and can be the same or different from the first sidewalls 913 and second sidewalls 912 thicknesses.

As shown in FIGS. 13-15, interlocking portions 914, including a distally-located tab 914*a* and blank 914*b*, are configured to lock the first sidewalls 912 and the second sidewalls 913 in position with respect to each. The tab 914*a* and blank 914*b* can be configured as described with respect to FIGS. 1-3. The interlocking portions 914 have a pair of grooves 992 configured and positioned to engage opposed edges 990 of opposing second sidewalls 912. Edges 990 can be narrowed portions of the second sidewalls 912. As the grooves 992 engage the edges 990, proximally-located hooks 915 of the interlocking portions 914 engage slots 986 of the opposing first sidewalls 913. For example, a user can maneuver the hooks 915 through the slots 986 with a proximal horizontal motion. The slots 986 can be sized and positioned to receive the hooks 915. The hooks 915 can be slid vertically down into the slots 986. The hooks 915 can be configured and sized so that when the hooks 915 are slid vertically down into the slots 986, the hooks 915 are locked into the slots such that the hooks 915 cannot be withdrawn by a distal horizontal force. The engagement of the hooks 915 with the slots 986 prevents the interlocking portions 914 from being removed from the slots 986 with a horizontal motion and locks the first sidewalls 913 and the second sidewalls 912 in configuration for use for construction. While two corresponding hooks and slots are shown, any suitable number of corresponding hooks and slots can be used, such as one, three, or four.

The tab 914*a* and the blank 914*b* are configured to interlock with a corresponding blank and tab of another construction block, as described above with respect to FIGS. 1-8. To interlock the construction blocks 910 to construct a wall, a first construction block can be held above and aligned with a second construction block such that when the first construction block is lowered into place, the tab of the first construction block slides into the blank of the second construction block and the tab of the second construction block slides into the blank of the first construction block to interlock the sidewalls of the first construction block and the second construction block. For example, the corresponding blank and tab of another construction block can slide vertically into the tab and blank such that the construction blocks are interlocked. Horizontal forces are prevented from pulling the construction blocks apart when the construction blocks are interlocked. The construction blocks can be separated again by sliding one vertically with respect to the other.

The construction block 910 can further include fasteners 920 for coupling the construction block to either the lid 950 or another construction block, as described above with respect to FIGS. 1-3. The fasteners 920 can extend beyond a top edge 924 of the first sidewalls 913 and second sidewalls 912. For example, the fasteners 920 can be tabs (as shown), cylindrical, or can have several sides, such as three, four, or six sides. The fasteners 920 can have any suitable dimensions for coupling the construction block.

The fasteners 920 can be received by a corresponding element of another construction block, such as an opening on a bottom surface of the bottom plate (not shown), or by an opening 952 in the lid 950. The fasteners 920 can be received with a friction fit. The construction block 910 may further be fastened to another construction block with adhesive, which can also be applied to the fasteners 920 and/or openings 952. The construction block 910 can be fastened to the top of another construction block. The top construction block serves as a cover for the container 917 of the construction block positioned below to contain any weight in the container 917 and prevent any other materials from being placed in the lower construction block. The number of fasteners 920 and corresponding openings 922 can be any suitable number for fastening one construction block to another. For example, the number of fasteners 120 and corresponding openings 122 and be in a range from 3 to 20.

The lid 950 has a congruent shape to the construction block when configured for use, and is configured to close the open space container 917 in the interior of the construction block 910. The lid 950 has openings 952 positioned to correspond to and receive the fasteners 920 such that the lid 950 is fastenable to the construction block 910, for example, with a friction fit. The dimensions of the openings 952 are dimensions that are suitable for receiving the fastener 920 with a friction fit. In this way, the lid 950 can be fastened to the construction block 910. The lid 950 may further be fastened to the construction block 910 with adhesive, which can also be applied to the fasteners 920 and/or openings 952. For example, the lids can be fastened to construction blocks at the top of a wall being constructed. The lid 950 can contain any weight in the container 917 and prevent any other materials from being placed in the lower construction block.

The construction block 910 and the lid 950 can be constructed of the same or different materials. For example, the construction block 910 and the lid 950 can be formed of plastics, polymers, composite materials, fiberglass, metal, foam, and recycled materials. The construction blocks can be various shapes and sizes such that various different structures can be assembled from the blocks. The different construction blocks can include different shapes so that walls can be constructed at various angles.

The container 917 can be filled with any suitable material to add weight to the construction block and stability to the structure, including, but not limited to, water, sand, concrete, dirt, rocks, and gravel.

A seal (not shown) can be positioned at the top edge 924 of the sidewall 912. The seal seals the construction block to either another construction block positioned above it or a lid to further contain any weight in the container and prevent any other materials from being placed in the container. The seal can be any suitable material, such as foam, rubber, polymers, plastic, silicone, and wax. The seal may also have an adhesive to adhere the seal to construction block and/or the seal. The seal can have any suitable thickness for sealing a lid or a construction block to another construction block.

CLOSING COMMENTS

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A construction block unit comprising:

a construction block comprising:

a bottom plate having a rectangular shape;

sidewalls attached to an outer edge of each side of the bottom plate via respective hinges, wherein the sidewalls are configured to rotate on the respective hinges from a position planar to the bottom plate for storage to a position perpendicular to the bottom plate to form a receptacle configured to receive and contain a weight; and a pair of interlocking portions, each positioned at opposite sides of the construction block, wherein an inner surface of each of the pair of interlocking portions engages the sidewalls to fasten the sidewalls in the position perpendicular to the bottom plate, wherein an outer surface of each of the pair of interlocking portions is configured to receive a corresponding interlocking portion of a second construction block by vertically sliding the corresponding interlocking portion into the interlocking portion.

2. The construction block unit of claim 1 further comprising a lid configured to be fastenable to a top edge of the sidewalls to enclose the receptacle.

3. The construction block unit of claim 2 further comprising a seal between the construction block and the lid configured to seal the lid to the construction block.

4. The construction block unit of claim 2 further comprising a plurality of fasteners coupled to the top edge of the sidewalls and configured to fasten the lid to the construction block.

5. The construction block unit of claim 4, wherein the lid comprises a plurality of openings each shaped and positioned to receive a respective one of the plurality of fasteners.

6. The construction block unit of claim 5, wherein each of the plurality of openings receives the respective one of the plurality of fasteners with a friction fit to couple the lid to the construction block.

7. The construction block unit of claim 5, wherein the bottom plate comprises a plurality of openings, each shaped and positioned to receive a respective one of a plurality of fasteners coupled to a top edge of a third construction block.

8. The construction block unit of claim 1, wherein the construction block is configured to couple to a third construction block positioned below the construction block.

9. The construction block unit of claim 1, wherein each of the interlocking portions comprises a first tab and a first blank, and wherein the corresponding interlocking portion comprises a second blank configured to receive the first tab and a second tab configured to receive the first blank.

10. The construction block unit of claim 1, wherein the sidewalls comprise a first pair of opposing sidewalls and a second pair of opposing side walls, wherein each of the first pair of opposing sidewalls comprise a pair of grooves perpendicular to the bottom plate, each groove configured and positioned to receive a respective one of opposing edges of one of the second pair of opposing sidewalls when the sidewalls are in the position perpendicular to the bottom plate.

11. The construction block unit of claim 10, wherein each of the first pair of sidewalls further comprise opposing edges, each configured to be received by one of the pair of interlocking portions.

12. The construction block unit of claim 11, wherein each of the second pair of opposing sidewalls comprises at least one slot, and wherein each of the pair of interlocking portions comprises at least one hook configured to be received by the at least one slot to fasten the sidewalls in the position perpendicular to the bottom plate.

13. The construction block unit of claim 1, wherein the respective hinges are integral hinges.

14. A construction block system comprising:

a first construction block comprising:

a first bottom plate having a rectangular shape;

first sidewalls attached to an outer edge of each side of the first bottom plate via respective hinges, wherein the first sidewalls are configured to rotate on the respective hinges from a position planar with the first bottom plate for storage to a position perpendicular to the first bottom plate to form a first receptacle configured to receive and contain a first weight; and a first pair of interlocking portions, each positioned at opposite sides of the first construction block, wherein an inner surface of each of the first pair of interlocking portions engages the first sidewalls to fasten the first sidewalls in the position perpendicular to the first bottom plate; and a second construction block comprising:

a second bottom plate having a rectangular shape;

second sidewalls attached to an outer edge of each side of the second bottom plate via respective hinges, and wherein the second sidewalls are configured to rotate on the respective hinges from a position planar with the second bottom plate for storage to a position perpendicular to the second bottom plate to form a second receptacle configured to receive and contain a second weight; and a second pair of interlocking portions, each positioned at opposite sides of the second construction block, wherein an inner surface of each of the second pair of interlocking portions engages the second sidewalls to fasten the second sidewalls in the position perpendicular to the second bottom plate, wherein an outer surface of one of the first pair of interlocking portions is shaped to receive an outer surface of one of the pair of second interlocking portions by vertically sliding the one of the pair of first interlocking portions into the one of the pair of second interlocking portions.

15. The construction block system of claim 14 further comprising a first lid configured to be fastenable to a top edge of the first sidewalls to enclose the first receptacle and a second lid configured to be fastenable to a top edge of the second sidewalls to enclose the second receptacle.

16. The construction block unit of claim 15 further comprising a first seal between the first construction block and the first lid configured to seal the first lid to the first construction block.

17. The construction block system of claim 14, wherein the first sidewalls comprise a first pair of opposing sidewalls and a second pair of opposing sidewalls, wherein each of the first pair of opposing sidewalls comprise a pair of grooves perpendicular to the first bottom plate, each groove configured and positioned to receive a respective one of opposing edges of the second pair of opposing sidewalls when the sidewalls are in the position perpendicular to the first bottom plate.

18. The construction block system of claim 17, wherein the first pair of sidewalls further comprise a tab configured to be received by one of the first pair of interlocking portions.

19. The construction block system of claim 18, wherein each of the second pair of opposing sidewalls comprises at least one slot, and wherein each of the first pair of interlocking portions comprises at least one hook configured to be received by the at least one slot to fasten the sidewalls in the position perpendicular to the bottom plate.

20. The construction block system of claim 14, wherein the respective hinges are integral hinges.

* * * * *